US008720149B2

(12) United States Patent
Bossuyt

(10) Patent No.: US 8,720,149 B2
(45) Date of Patent: May 13, 2014

(54) FLOOR PANEL

(71) Applicant: IVC N.V., Avelgem (BE)

(72) Inventor: Filip Gilbert Lucien Bossuyt, Avelgem (BE)

(73) Assignee: IVC N.V. (BE)

( * ) Notice: Subject to any disclaimer, the term of this patent is extended or adjusted under 35 U.S.C. 154(b) by 0 days.

(21) Appl. No.: 13/739,483

(22) Filed: Jan. 11, 2013

(65) Prior Publication Data

US 2013/0180193 A1 Jul. 18, 2013

(30) Foreign Application Priority Data

Jan. 12, 2012 (BE) ..... 2012/0027

(51) Int. Cl.
*E04B 2/00* (2006.01)

(52) U.S. Cl.
USPC ..... 52/582.2; 52/588.1; 52/582.1; 52/583.1; 52/592.2

(58) Field of Classification Search
USPC ..... 52/588.1, 582.1, 582.2, 583.1, 589.1, 52/592.1, 592.2; 428/58, 60
See application file for complete search history.

(56) References Cited

U.S. PATENT DOCUMENTS

| | | | | |
|---|---|---|---|---|
| 7,896,571 | B1 * | 3/2011 | Hannig et al. | 403/339 |
| 8,037,656 | B2 * | 10/2011 | Liu et al. | 52/589.1 |
| 2009/0133358 | A1 | 5/2009 | Hecht | |
| 2010/0115874 | A1 * | 5/2010 | Nilsson | 52/588.1 |
| 2011/0088346 | A1 * | 4/2011 | Hannig | 52/588.1 |
| 2011/0131909 | A1 * | 6/2011 | Hannig | 52/309.1 |
| 2011/0280655 | A1 * | 11/2011 | Maertens et al. | 403/375 |
| 2011/0296780 | A1 * | 12/2011 | Windmoller | 52/309.1 |
| 2012/0180416 | A1 * | 7/2012 | Perra et al. | 52/309.1 |
| 2013/0047536 | A1 * | 2/2013 | Pervan | 52/309.1 |
| 2013/0104486 | A1 * | 5/2013 | Windmoller | 52/588.1 |

FOREIGN PATENT DOCUMENTS

| | | | |
|---|---|---|---|
| DE | 202009008825 | U1 | 10/2009 |
| EP | 1493878 | A1 | 1/2005 |
| WO | WO-2007141605 | A2 | 12/2007 |

OTHER PUBLICATIONS

"Belgian Application No. BE2012/0027, Search Report and Written Opinion dated Nov. 1, 2012", 9 pgs.

* cited by examiner

*Primary Examiner* — Robert Canfield
*Assistant Examiner* — Matthew Gitlin
(74) *Attorney, Agent, or Firm* — Schwegman, Lundberg & Woessner, P.A.

(57) ABSTRACT

A rectangular floor panel is described with mutually parallel, substantially planar upper and lower sides and with two pairs of respective mutually opposite side edges connecting the upper and lower sides, wherein the opposite side edges of a pair are provided with complementary profiles for interconnecting adjacent floor panels. Of at least one pair of opposite side edges the profile of a first side edge is provided with a frontal face and a counter face, whereas the profile of the corresponding second side edge of the respective pair of opposite side edges is provided with a frontal face and counter face, respectively, cooperating therewith. The frontal faces and the counter faces are provided with locking tabs cooperating in the interconnected position of adjacent floor panels. The floor panel further is provided with two reinforcement layers extending substantially in parallel to the upper and lower sides of the floor panel, wherein the locking tabs substantially are positioned at the level of said reinforcement layers.

18 Claims, 1 Drawing Sheet

FLOOR PANEL

PRIORITY CLAIM AND RELATED APPLICATIONS

This application claims the benefit of priority under 35 U.S.C. Section 119 to Belgian Patent Application Serial No. BE2012/0027, filed on Jan. 12, 2012, which application is incorporated herein by reference in its entirety.

TECHNICAL FIELD

The invention relates to a rectangular floor panel with mutually parallel, substantially planar upper and lower sides and with two pairs of respective mutually opposite side edges connecting the upper and lower sides, wherein the opposite side edges of a pair are provided with complementary profiles for interconnecting adjacent floor panels, wherein of at least one pair of opposite side edges the profile of a first side edge is defined by a frontal face extending substantially vertically from the upper side and over part of the thickness of the floor panel, a first support face extending inwardly substantially in a horizontal direction from the lower end of said frontal face, a locking face extending upwardly from the inner end of said first support face to a position at some distance from the upper side of the floor panel, a second support face extending inwardly again from the upper end of said locking face and finally a counter face extending downwardly from the inner end of said second support face all the way to the lower side of the floor panel, and wherein the profile of the corresponding second side edge of the respective pair of opposite side edges is defined by a frontal face extending substantially vertically from the lower side and over part of the thickness of the floor panel, a first support face extending inwardly substantially in a horizontal direction from the upper end of said frontal face, a locking face extending downwardly from the inner end of said first support face to a position at some distance from the lower side of the floor panel, a second support face extending inwardly again from the lower end of said locking face and finally a counter face extending upwardly from the inner end of said second support face all the way to the upper side of the floor panel, wherein for maintaining two adjacent floor panels in an interconnected position a frontal face of a profile cooperates with a counter face of the other profile, the first support face of a profile cooperates with the second support face of the other profile and the locking faces of both profiles cooperate with each other, and wherein the frontal faces and the counter faces are provided with locking tabs cooperating in the interconnected position of adjacent floor panels.

SUMMARY

Such a type of floor panel is known from the US patent application 2009/133358. The described profiles with locking tabs in the interconnected state of adjacent floor panels create a locking between adjacent panels in the horizontal and vertical direction. In particular, primarily the cooperation between the frontal faces and the counter faces and between the locking faces causes a horizontal locking, whereas the vertical locking (and positioning in a common plane) primarily is caused by the cooperation between the first and second support faces and between the locking tabs. However, it is noted that the term cooperating should not be construed in such a limited sense that the respective faces at all times would engage each other.

It is an object of the present invention to provide an improved floor panel of the type referred to above.

Thus, in accordance with the present invention the floor panel further is provided with two reinforcement layers extending substantially in parallel to the upper and lower sides of the floor panel, wherein the locking tabs substantially are positioned at the level of said reinforcement layers.

By virtue of the use of the reinforcing layers it becomes possible to optimally adapt several parts of the floor panel to demands imposed thereupon using an appropriate choice of material, without detrimentally influencing the effect of the operation of the locking tabs. By means of the reinforcement layers the locking tabs at one hand may be designed sufficiently flexible, while at the other hand being sufficiently strong. Further it becomes possible to make the reinforcement layers stiffer than the remainder of the floor panel (which possible may be constructed from components having a different modulus of elasticity).

A floor panel to which the present invention relates may, in a manner known per se, be constructed from different layers and may have different dimensions and thicknesses. Within the scope of the present invention it is not necessary to further elucidate these aspects. Further it is possible that the floor panel (or components thereof) comprise a considerable amount (for example more than 30%) of recycled (plastic) material.

Using the invention a floor panel is provided which together with corresponding floor panels may be interconnected in an easy manner for creating a floor covering which during a prolonged life defines a stable assembly. The floor panel may be machined in many, very diverse manners.

In a preferred embodiment of the floor panel according to the present invention, the reinforcement layers extend into the locking tabs. As a result these locking tabs in an optimal manner take advantage of the effect of these reinforcement layers.

However, the above does not preclude the possibility that the reinforcement layers end near to the locking tabs without extending therein. Also in such a case a strengthening effect on the locking tabs already may be obtained.

Preferably the locking tabs and the reinforcement layers are positioned in the immediate vicinity of the lower side and upper side of the floor panel.

The (locking) forces acting between floor panels in the interconnected position of such adjacent floor panels extend inclined between pairs of cooperating locking tabs at the upper side and at the lower side of the floor panels. The closer such pairs of cooperating locking tabs are to the upper side and lower side, respectively, of the floor panels, the larger will be the part of the thickness of said floor panels contributing to the force transmittal (and the more strong the connection between the adjacent floor panels will be).

In one embodiment of the floor panel the lower and upper reinforcement layers are positioned at a level of between 8 and 14% and a level of between 93 and 96%, respectively, of the total thickness of the floor panel. For example, when the floor panel has a thickness of about 4.5 mm, the lower and upper reinforcement layers then are positioned at a level of between 0.4 and 0.6 mm and a level of between 4.2 and 4.3 mm, respectively, above the lower side of the floor panel.

The above does not preclude that the floor panel also may have a different thickness, for example between 4 and 8 mm.

In another embodiment of the floor panel according to the present invention the upper reinforcement layer is positioned above the second support face of the profile of the first side edge and wherein the lower reinforcement layer is positioned below the second support face of the profile of the second side edge.

Basically this means that both reinforcement layers extend uninterrupted along the entire length (and/or width) of the floor panel without being interrupted by the profiles defined at the respective side edges, such that their reinforcing effect may be used in an optimal manner.

The reinforcement layers may comprise a woven or non-woven fibre material, for example a glass fibre material. They may have a thickness of 0.2-0.4 mm.

In another embodiment of the floor panel according to the present invention the locking face of the profile of the first side edge is inclined upwardly and inwardly with a first angle of 14-21° with respect to the vertical, whereas the locking face of the profile of the second side edge is inclined downwardly and inwardly with a second angle of 15-22° with respect to the vertical and wherein the second angle is at most 1° larger than the first angle.

As a result of such a shape, interconnecting two adjacent floor panels may be carried out with ease, while the said locking faces slide along each other and the locking gradually get engaged. The optimal angles depend from the shape and material properties of the locking tabs.

Interconnecting adjacent floor panels at said first and second side edges primarily occurs through a mutual vertical (translating) connecting movement. When both pairs of opposite side edges are provided with said complementary profiles with frontal faces, first and second support faces, locking faces and counter faces, such a vertical motion occurs everywhere.

However, it is conceivable too that laying floor panels is a combination of (primarily) a rotation around one of the side edges, whereas at the two side edges perpendicular to said side edge primarily a vertical motion occurs. In such a case the respective shape will differ among pairs of opposite side edges, as is known per se.

The floor panel substantially may comprise a number of stacked plastic-based layers, such as for example a top layer comprising a first reinforcing layer, and a core layer positioned there below comprising a second reinforcing layer. Further it is possible that the top layer successively comprises a transparent finishing layer, a decorative layer and a thermoplastic support layer. The core layer may comprise a thermoplastic material.

In another embodiment the floor panel comprises bevels at the connection of the frontal face of the profile of the first side edge and the connection of the counter face of the profile of the second edge, respectively, with the upper side of the floor panel. Such bevels may be manufactured in different ways, for example by locally heating and next displacing material and/or by milling off material.

BRIEF DESCRIPTION OF THE DRAWINGS

Hereinafter the invention is elucidated by means of the drawing, in which.

DETAILED DESCRIPTION

Figure 1:
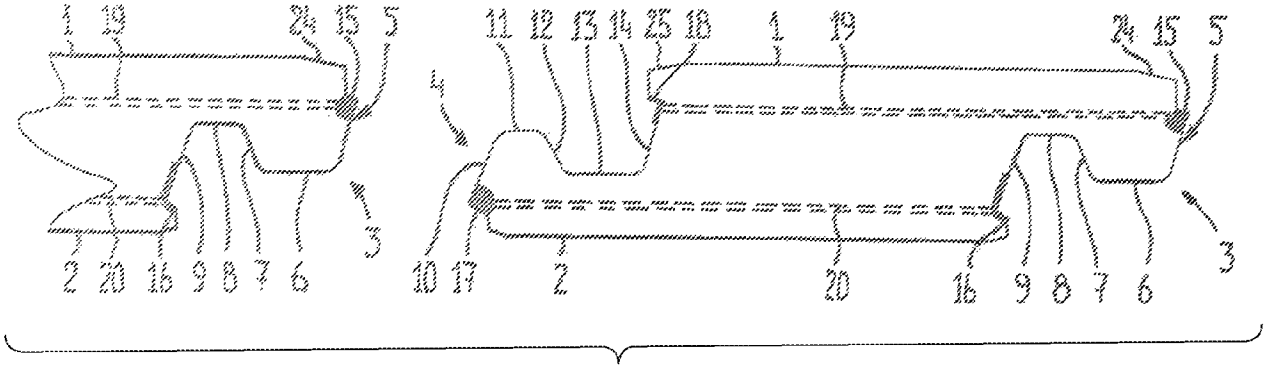
FIG. 1 illustrates a cross section of two adjacent, not yet interconnected, floor panels according to the invention.

It is noted that indications of directions and positions always relate to floor panels which assume a horizontal, planar position. In the respective figures a cross section is illustrated of (in a top plan view) substantially rectangular floor panels. Each floor panel comprises a planar upper side 1 and a substantially planar lower side 2 in parallel therewith. Further, each panel comprises two pairs of respective mutually opposite side edges 3,4 connecting the upper and lower sides. In the figures always only the side edges belonging to one pair are shown.

The opposite side edges of a pair are provided with complementary profiles for interconnecting adjacent floor panels. In the illustrated embodiment the profile of a first side edge 3 of the illustrated pair of opposite side edges is defined by a frontal face 5 extending substantially vertically from the upper side 1 and over part of the thickness of the floor panel, a first support face 6 extending inwardly substantially in a horizontal direction from the lower end of said frontal face 5, a locking face 7 extending upwardly from the inner end of said first support face 6 to a position at some distance from the upper side 1 of the floor panel, a second support face 8 extending inwardly again from the upper end of said locking face 7 and finally a counter face 9 extending downwardly from the inner end of said second support face 8 all the way to the lower side 2 of the floor panel.

In a corresponding manner the profile of the corresponding second side edge 4 of the respective pair of opposite side edges is defined by a frontal face 10 extending substantially vertically from the lower side 2 and over part of the thickness of the floor panel, a first support face 11 extending inwardly substantially in a horizontal direction from the upper end of said frontal face 10, a locking face 12 extending downwardly from the inner end of said first support face 11 to a position at some distance from the lower side 2 of the floor panel, a second support face 13 extending inwardly again from the lower end of said locking face 12 and finally a counter face 14 extending upwardly from the inner end of said second support face 13 all the way to the upper side 1 of the floor panel.

Figure 3:
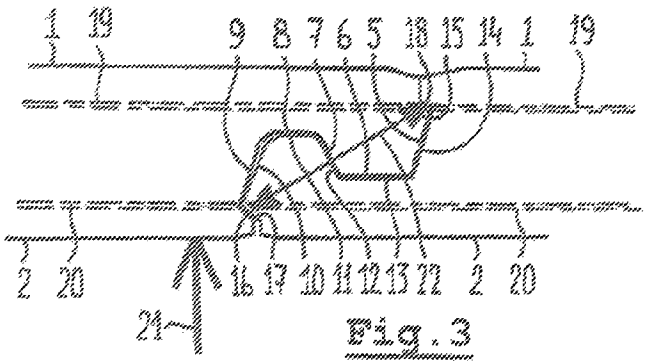
FIG. 3 illustrates a cross section of two adjacent, interconnected, floor panels according to the invention.

For in an interconnected position maintaining the relative position of two adjacent floor panels (see FIG. 3) a frontal face 5 and 10, respectively, of a profile cooperates with a counter face 14 and 9, respectively, of the other profile. Further, the first support face 6 and 11, respectively, of a profile cooperates with the second support face 13 and 8, respectively, of the other profile. Finally the locking faces 7 and 12 of both profiles cooperate with each other.

The frontal faces 5,10 and the counter faces 9,14 are provided with locking tabs 15-18 cooperating in the interconnected position of adjacent floor panels. In the interconnected position (FIG. 3) the tabs 15 and 17 engage behind the tabs 18 and 16, such that basically a good mutual vertical locking between adjacent floor panels is obtained.

The floor panel further is provided with two reinforcement layers 19,20 extending substantially in parallel to the upper and lower sides of the floor panel, wherein the locking tabs 15-18 substantially are positioned at the level of said reinforcement layers. The reinforcement layers 19,20 may extend into the locking tabs 15-18 (for example all the way to the most protruding part thereof) but may also end close thereto.

The locking tabs 15-18 and the reinforcement layers 19,20 are positioned in the immediate vicinity of the lower side 2 and upper side 1 of the floor panel. As a result, when one tries to move the floor panels apart (force 21) in the interconnected position of adjacent floor panels (FIG. 3), a connecting force (arrow 22) is created which extends inclined over a large part of the total thickness of the floor panels, thus in an optimal manner using the strength of the floor panels.

For example it is possible that the lower and upper reinforcement layers 20 and 19, respectively, are positioned at a level of between 8 and 14% and a level of between 93 and 96%, respectively, of the total thickness of the floor panel (counted from the lower side 2 of the floor panel).

The upper reinforcement layer 19 is positioned above the second support face 8 of the profile of the first side edge 3, whereas the lower reinforcement layer 20 is positioned below the second support face 13 of the profile of the second side edge 4. As a result these reinforcing layers are not interrupted by these profiles.

Figure 2:
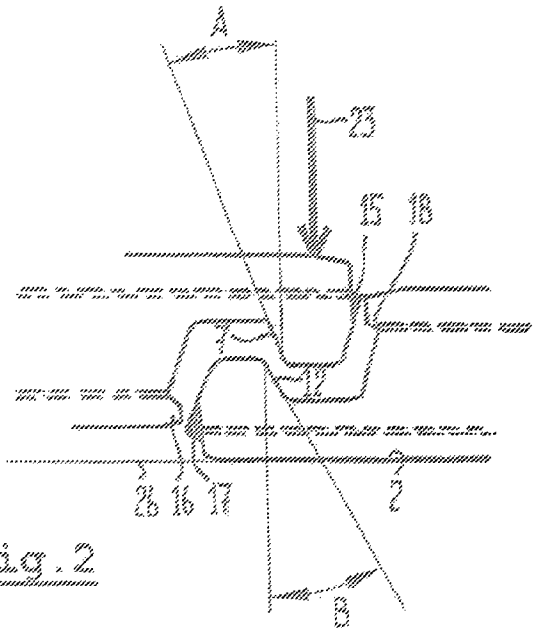
FIG. 2 illustrates a cross section of two adjacent floor panels according to the invention during interconnecting.

As illustrated in FIG. 2, the locking face 7 of the profile of the first side edge 3 is inclined upwardly and inwardly with a first angle A of 14-21° with respect to the vertical, whereas the locking face 12 of the profile of the second side edge 4 is inclined downwardly and inwardly with a second angle B of 15-22° with respect to the vertical. The second angle B is at most 1° larger than the first angle A. As a result of such an inclined orientation of the locking faces 7,12 the locking movement, during which the locking faces slide along each other, may occur in an optimal manner while bringing the cooperating locking tabs 15,18 and 17,16, respectively, into engagement with each other. Such a movement occurs by (according to arrow 23) pressing down a floor panel while the adjacent floor panel rests on a floor 26 with its lower side.

Finally the floor panel according to the present invention may comprise bevels 24,25 at the connection of the frontal face 5 of the profile of the first side edge 3 and the connection of the counter face 14 of the profile of the second edge 4, respectively, with the upper side 1 of the floor panel. This may contribute to obtaining a decorative appearance in the assembled position.

The invention is not limited to the embodiments described before which may be varied widely within the scope of the invention as defined by the appending claims.

What is claimed is:

1. A rectangular floor panel with mutually parallel, substantially planar upper and lower sides and with two pairs of respective mutually opposite side edges connecting the upper and lower sides, wherein the opposite side edges of a pair are provided with complementary profiles for interconnecting adjacent floor panels, wherein of at least one pair of opposite side edges the profile of a first side edge is defined by a frontal face extending substantially vertically from the upper side and over part of the thickness of the floor panel, a first support face extending inwardly substantially in a horizontal direction from the lower end of said frontal face, a locking face extending upwardly from the inner end of said first support face to a position at some distance from the upper side of the floor panel, a second support face extending inwardly again from the upper end of said locking face and finally a counter face extending downwardly from the inner end of said second support face all the way to the lower side of the floor panel, and wherein the profile of the corresponding second side edge of the respective pair of opposite side edges is defined by a frontal face extending substantially vertically from the lower side and over part of the thickness of the floor panel, a first support face extending inwardly substantially in a horizontal direction from the upper end of said frontal face, a locking face extending downwardly from the inner end of said first support face to a position at some distance from the lower side of the floor panel, a second support face extending inwardly again from the lower end of said locking face and finally a counter face extending upwardly from the inner end of said second support face all the way to the upper side of the floor panel, wherein for maintaining two adjacent floor panels in an interconnected position a frontal face of a profile cooperates with a counter face of the other profile, the first support face of a profile cooperates with the second support face of the other profile and the locking faces of both profiles cooperate with each other, and wherein the frontal faces and the counter faces are provided with locking tabs cooperating in the interconnected position of adjacent floor panels, wherein the floor panel further is provided with two reinforcement layers extending substantially in parallel to the upper and lower sides of the floor panel, wherein one of the locking tabs substantially is positioned at the level of an upper one of said reinforcement layers, and another one of the locking tabs substantially is positioned at the level of a lower one of said reinforcement layers.

2. The floor panel according to claim 1, wherein the reinforcement layers extend into the locking tabs.

3. The floor panel according to claim 1, wherein the locking tabs and the reinforcement layers are positioned in the immediate vicinity of the lower side and upper side of the floor panel.

4. The floor panel according to claim 3, wherein the lower and upper reinforcement layers are positioned at a level of between 8 and 14% and a level of between 93 and 96%, respectively, of the total thickness of the floor panel.

5. The floor panel according to claim 4 having a thickness of about 4.5 mm, wherein the lower and upper reinforcement layers are positioned at a level of between 0.4 and 0.6 mm and a level of between 4.2 and 4.3 mm, respectively, above the lower side of the floor panel.

6. The floor panel according to claim 1, wherein the upper reinforcement layer is positioned above the second support face of the profile of the first side edge and wherein the lower reinforcement layer is positioned below the second support face of the profile of the second side edge.

7. The floor panel according to claim 1, wherein the reinforcement layers comprise a woven or non-woven fibre material.

8. The floor panel according to claim 7, wherein the reinforcement layers comprise a glass fibre material.

9. The floor panel according to claim 1, wherein the reinforcement layers have a thickness of 0.2-0.4 mm.

10. The floor panel according to claim 1, wherein the locking face of the profile of the first side edge is inclined upwardly and inwardly with a first angle of 14-21° with respect to the vertical, whereas the locking face of the profile of the second side edge is inclined downwardly and inwardly with a second angle of 15-22° with respect to the vertical and wherein the second angle is at most 1° larger than the first angle.

11. The floor panel according to claim 1, wherein both pairs of opposite side edges are provided with said complementary profiles with frontal faces, first and second support faces, locking faces and counter faces.

12. The floor panel according to claim 1, and substantially comprising a number of stacked plastic-based layers and a core layer positioned there below comprising a second reinforcing layer.

13. The floor panel according to claim 12, wherein the top layer successively comprises a transparent finishing layer, a decorative layer and a thermoplastic support layer.

14. The floor panel according to claim 12, wherein the core layer comprises a thermoplastic material.

15. The floor panel according to claim 1 and comprising bevels at the connection of the frontal face of the profile of the first side edge and the connection of the counter face of the profile of the second edge, respectively, with the upper side of the floor panel.

16. The floor panel according to claim 12, wherein the number of stacked plastic-based layers includes a top layer comprising a first reinforcing layer.

17. A rectangular floor panel with mutually parallel, substantially planar upper and lower sides and with two pairs of respective mutually opposite side edges connecting the upper and lower sides, wherein the opposite side edges of a pair are provided with complementary profiles for interconnecting adjacent floor panels, wherein of at least one pair of opposite side edges the profile of a first side edge is defined by a frontal face extending substantially vertically from the upper side and over part of the thickness of the floor panel, a first support face extending inwardly substantially in a horizontal direction from the lower end of said frontal face, a locking face extending upwardly from the inner end of said first support face to a position at some distance from the upper side of the floor panel, a second support face extending inwardly again from the upper end of said locking face and finally a counter face extending downwardly from the inner end of said second support face all the way to the lower side of the floor panel, and wherein the profile of the corresponding second side edge of the respective pair of opposite side edges is defined by a frontal face extending substantially vertically from the lower side and over part of the thickness of the floor panel, a first support face extending inwardly substantially in a horizontal direction from the upper end of said frontal face, a locking face extending downwardly from the inner end of said first support face to a position at some distance from the lower side of the floor panel, a second support face extending inwardly again from the lower end of said locking face and finally a counter face extending upwardly from the inner end of said second support face all the way to the upper side of the floor panel, wherein for maintaining two adjacent floor panels in an interconnected position a frontal face of a profile cooperates with a counter face of the other profile, the first support face of a profile cooperates with the second support face of the other profile and the locking faces of both profiles cooperate with each other, and wherein the frontal faces and the counter faces are provided with locking tabs cooperating in the interconnected position of adjacent floor panels, wherein the floor panel further is provided with two reinforcement layers extending substantially in parallel to the upper and lower sides of the floor panel, wherein one of the locking tabs substantially is positioned at the level of an upper one of said reinforcement layers, and another one of the locking tabs substantially is positioned at the level of a lower one of said reinforcement layers, wherein the upper reinforcement layer is positioned above the second support face of the profile of the first side edge, and wherein the lower reinforcement layer is positioned below the second support face of the profile of the second side edge.

18. A rectangular floor panel with mutually parallel, substantially planar upper and lower sides and with two pairs of respective mutually opposite side edges connecting the upper and lower sides, wherein the opposite side edges of a pair are provided with complementary profiles for interconnecting adjacent floor panels, wherein of at least one pair of opposite side edges the profile of a first side edge is defined by a frontal face extending substantially vertically from the upper side and over part of the thickness of the floor panel, a first support face extending inwardly substantially in a horizontal direction from the lower end of said frontal face, a locking face extending upwardly from the inner end of said first support face to a position at some distance from the upper side of the floor panel, a second support face extending inwardly again from the upper end of said locking face and finally a counter face extending downwardly from the inner end of said second support face all the way to the lower side of the floor panel, and wherein the profile of the corresponding second side edge of the respective pair of opposite side edges is defined by a frontal face extending substantially vertically from the lower side and over part of the thickness of the floor panel, a first support face extending inwardly substantially in a horizontal direction from the upper end of said frontal face, a locking face extending downwardly from the inner end of said first support face to a position at some distance from the lower side of the floor panel, a second support face extending inwardly again from the lower end of said locking face and finally a counter face extending upwardly from the inner end of said second support face all the way to the upper side of the floor panel, wherein for maintaining two adjacent floor panels in an interconnected position a frontal face of a profile cooperates with a counter face of the other profile, the first support face of a profile cooperates with the second support face of the other profile and the locking faces of both profiles cooperate with each other, and wherein the frontal faces and the counter faces are provided with locking tabs cooperating in the interconnected position of adjacent floor panels, wherein the floor panel further is provided with two reinforcement layers extending substantially in parallel to the upper and lower sides of the floor panel, wherein one of the locking tabs substantially is positioned at the level of an upper one of said reinforcement layers, and another one of the locking tabs substantially is positioned at the level of a lower one of said reinforcement layers, wherein the locking face of the profile of the first side edge is inclined upwardly and inwardly with a first angle of 14-21° with respect to the vertical, whereas the locking face of the profile of the second side edge is inclined downwardly and inwardly with a second angle of 15-22° with respect to the vertical and wherein the second angle is at most 1° larger than the first angle.

* * * * *